US010786040B2

(12) United States Patent
Madore

(10) Patent No.: US 10,786,040 B2
(45) Date of Patent: Sep. 29, 2020

(54) MULTI-DUROMETER SOLE STRUCTURE FOR AN ARTICLE OF FOOTWEAR

(71) Applicant: NIKE, Inc., Beaverton, OR (US)

(72) Inventor: Carl L. Madore, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 459 days.

(21) Appl. No.: 15/165,622

(22) Filed: May 26, 2016

(65) Prior Publication Data

US 2017/0340053 A1 Nov. 30, 2017

(51) Int. Cl.

| | |
|---|---|
| ***A43B 13/18*** | (2006.01) |
| ***A43B 13/12*** | (2006.01) |
| ***A43B 5/00*** | (2006.01) |
| ***A43B 13/22*** | (2006.01) |

(52) U.S. Cl.

CPC ..... *A43B 13/188* (2013.01); *A43B 5/001* (2013.01); *A43B 13/122* (2013.01); *A43B 13/223* (2013.01)

(58) Field of Classification Search

CPC ... A43B 13/188; A43B 13/223; A43B 13/122; A43B 13/12; A43B 5/001

See application file for complete search history.

(56) References Cited

U.S. PATENT DOCUMENTS 4,597,196 A * 7/1986 Brown ..... A43B 1/0072 36/140
4,682,425 A 7/1987 Simmons
4,685,227 A 8/1987 Simmons
4,864,739 A 9/1989 Maestri
4,896,441 A 1/1990 Galasso
4,953,311 A 9/1990 Bruggemeier
5,014,706 A 5/1991 Philipp
5,187,885 A 2/1993 Murphy
5,400,528 A * 3/1995 Skinner ..... A43B 7/1465 36/145
5,542,196 A 8/1996 Kantro
5,669,162 A * 9/1997 Dyer ..... A43B 7/142 36/37
5,787,610 A * 8/1998 Brooks ..... A43B 1/0027 36/169
6,038,790 A * 3/2000 Pyle ..... A43B 7/1425 36/28
6,158,151 A 12/2000 Won
6,510,626 B1 * 1/2003 Greenawalt ..... A43B 7/142 36/160
6,973,743 B1 12/2005 Mowery
7,210,250 B2 5/2007 Gallegos
(Continued)

*Primary Examiner* — Katharine Gracz
(74) *Attorney, Agent, or Firm* — Quinn IP Law

(57) ABSTRACT

A multi-durometer sole structure includes a sole structure body including a forefoot region, a heel region, and a midfoot region between the heel region and the forefoot region, a medial edge, and a lateral edge opposite the medial edge. The sole structure body further includes a first body segment extending along the forefoot region, the midfoot region, and the heel region, a second body segment extending along the forefoot region, the midfoot region, and the heel region, and a third body segment extending along midfoot region and the heel region. The first, second, and third body segments are made of different materials having three different hardnesses, respectively, such that a total hardness of the sole structure body varies from the medial edge to the lateral edge.

29 Claims, 2 Drawing Sheets

(56) References Cited

U.S. PATENT DOCUMENTS 7,484,319 B2 * 2/2009 Cheskin ..... A43B 7/141 36/144
7,526,882 B2 5/2009 Rhenter
7,555,849 B2 7/2009 Canvin
7,908,768 B2 * 3/2011 Cheskin ..... A43B 7/141 36/144
8,122,550 B2 2/2012 Johnson
8,250,783 B2 * 8/2012 Luthi ..... A43B 7/142 36/155
8,371,047 B2 2/2013 Johnson
8,453,346 B2 * 6/2013 Steszyn ..... A43B 7/142 36/146
8,479,413 B2 * 7/2013 Avent ..... A43B 7/14 36/108
8,667,715 B2 * 3/2014 Santopietro ..... A43B 7/141 36/140
9,380,831 B2 * 7/2016 Craig ..... A41B 11/02
9,775,402 B2 * 10/2017 Nonogawa ..... A43B 5/10
2002/0050080 A1 * 5/2002 Vasyli ..... A43B 7/141 36/145
2003/0014881 A1 * 1/2003 Hay ..... A43B 7/141 36/25 R
2003/0093920 A1 * 5/2003 Greene ..... A43B 7/141 36/25 R
2003/0172548 A1 * 9/2003 Fuerst ..... A43B 13/026 36/28
2003/0192202 A1 * 10/2003 Schoenborn ..... A43B 7/142 36/30 R
2004/0118017 A1 * 6/2004 Dalton ..... A43B 7/142 36/44
2004/0194344 A1 * 10/2004 Tadin ..... A43B 7/141 36/44
2006/0080862 A1 * 4/2006 Hay ..... A43B 7/142 36/25 R
2007/0033834 A1 * 2/2007 Cheskin ..... A43B 7/141 36/44
2008/0086909 A1 * 4/2008 Raspini ..... A43B 5/001 36/44
2009/0094861 A1 * 4/2009 Orvitz ..... A43B 1/0081 36/91
2009/0119947 A1 * 5/2009 Orvitz ..... A43B 7/141 36/44
2011/0258879 A1 10/2011 Dananberg et al.
2013/0081306 A1 4/2013 Park et al.
2015/0157089 A1 * 6/2015 Schumacher ..... A43B 3/0057 36/25 R
2015/0237959 A1 * 8/2015 Wynn ..... A43B 7/142 36/44
2015/0282561 A1 * 10/2015 Swager Van Dok ..... A43B 3/0057 36/31

* cited by examiner

MULTI-DUROMETER SOLE STRUCTURE FOR AN ARTICLE OF FOOTWEAR

TECHNICAL FIELD

The present disclosure relates to a multi-durometer sole structure for an article of footwear.

BACKGROUND

Footwear typically includes a sole configured to be located under a wearer's foot to space the foot away from the ground or floor surface. Soles can be designed to provide a desired level of cushioning. The ground contact surface of the article of footwear can be configured for durability

SUMMARY

During the follow through of a golf swing, a golfer should pronate his back foot more than his front in order to maximize the distance and accuracy of the golf shot. Accordingly, it is desirable to induce foot pronation during the follow through of a golf swing. Training, however, is necessary to induce foot pronation during a golf swing. To this end, the present disclosure describes a multi-durometer sole structure for an article of footwear. In certain embodiments, the multi-durometer sole structure includes a sole structure body including a forefoot region, a heel region, and a midfoot region between the heel region and the forefoot region, a medial edge, and a lateral edge opposite the medial edge. The sole structure body further includes a first body segment extending along the forefoot region, the midfoot region, and the heel region, a second body segment extending along the forefoot region, the midfoot region, and the heel region, and a third body segment extending along the midfoot region and the heel region. The first, second, and third body segments are made of different materials having three different hardnesses, respectively. As such, the total hardness of the sole structure body varies from the medial edge to the lateral edge in order to induce foot pronation during a golf swing. Each of the first body segment and the second body segment defines an inner body surface and an outer body surface opposite the inner body surface, and the inner body surface of the first body segment is flushed with the inner body surface of the second body segment.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items.

Those having ordinary skill in the art will recognize that terms such as "above," "below," "upward," "downward," "top," "bottom," etc., are used descriptively for the figures, and do not represent limitations on the scope of the present teachings, as defined by the claims.

The above features and advantages and other features and advantages of the present teachings are readily apparent from the following detailed description of the best modes for carrying out the teachings when taken in connection with the accompanying drawings.

DETAILED DESCRIPTION

Figure 1:
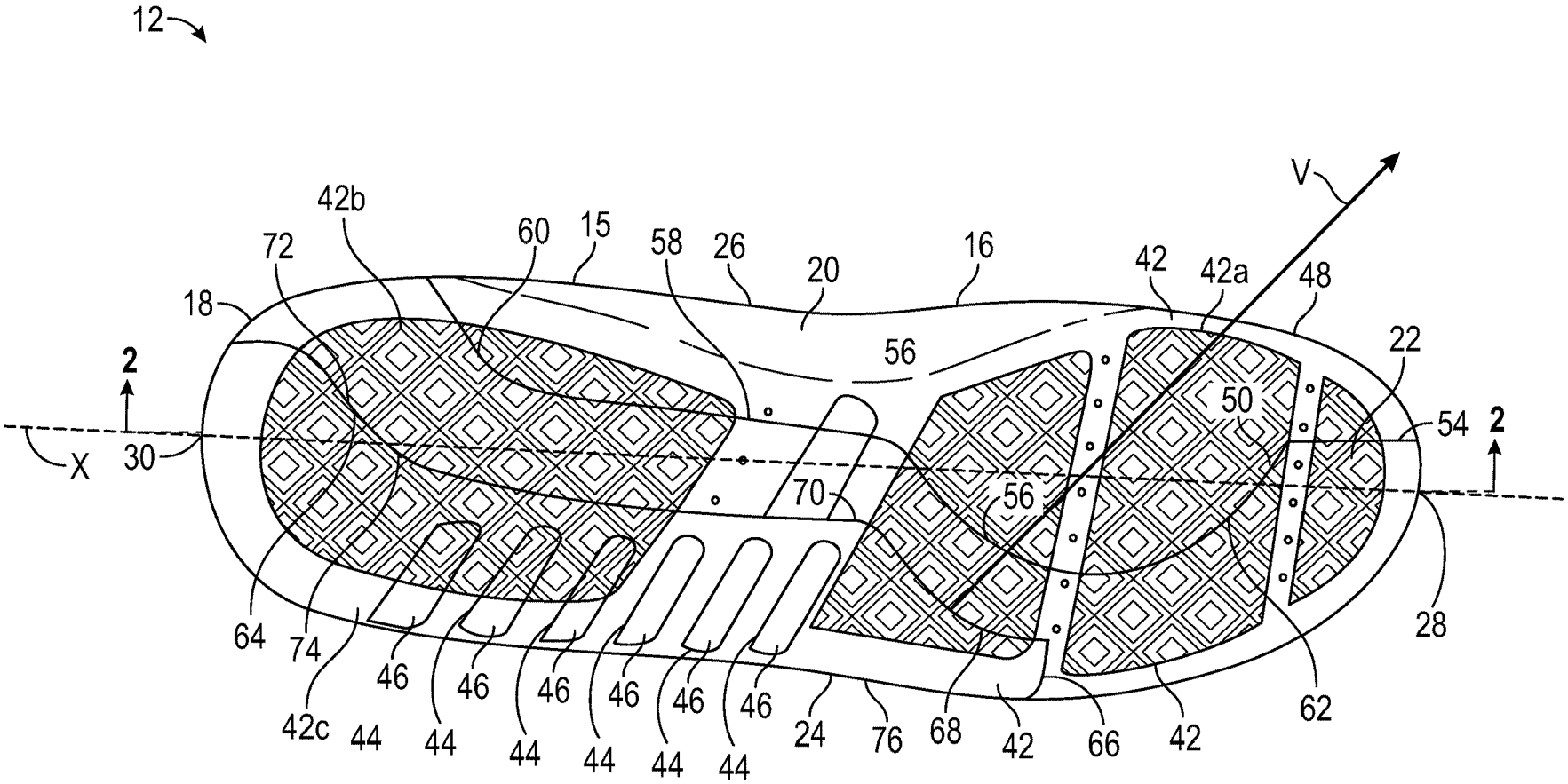
FIG. 1 is a schematic top view of a sole structure for an article of footwear.
Figure 2:
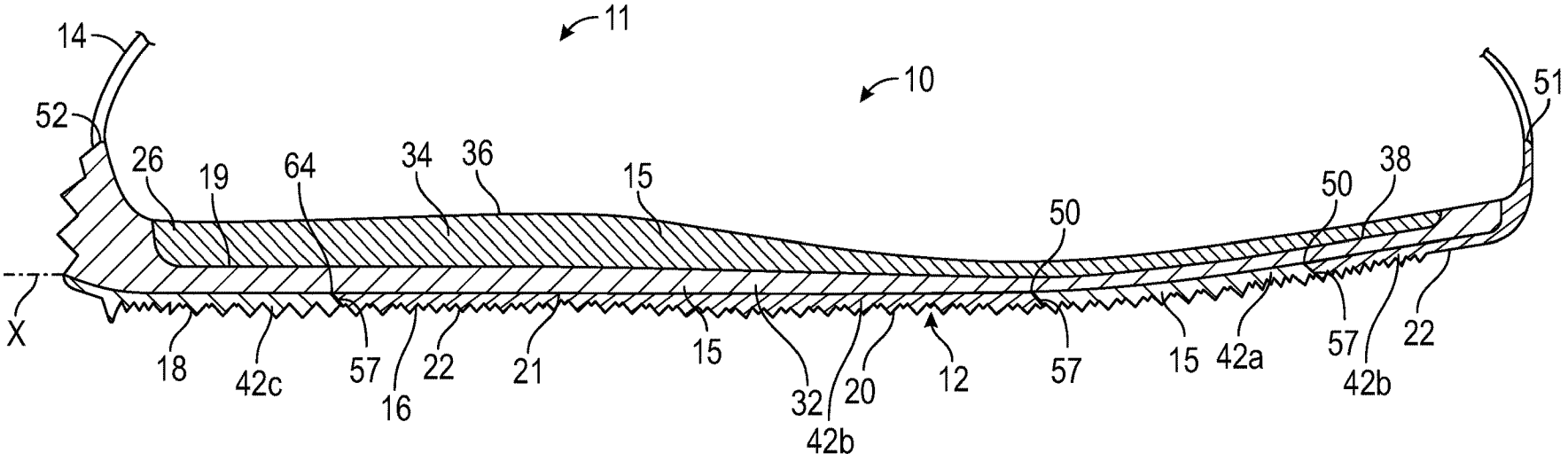
FIG. 2 is a schematic, cross-sectional view of the sole structure shown in FIG. 1.

Referring to the drawings, wherein like reference numbers correspond to like or similar components throughout the several figures, FIGS. 1 and 2 schematically illustrate a sole structure 12 for an article of footwear 10. The article of footwear 10 further includes a footwear upper 14 (FIG. 1) secured to the sole structure 12. As a non-limiting example, the article of footwear 10 may be a golf shoe 11. The sole structure 12 includes one or more sole structure bodies 15. For example, one of the sole structure bodies 15 may be an outsole 16 configured to contact the ground.

For purposes of reference, the outsole 16 (or any other sole structure body 15) extends along a central longitudinal axis X and has a heel region 18, a midfoot region 20, and a forefoot region 22. The midfoot region 20 is disposed between the heel region 18 and the forefoot region 22. For purposes of discussion, the heel region 18, the midfoot region 20, and the forefoot region 22 are defined as the rearmost third, the middle third, and the foremost third of the outsole 16, respectively. The heel region 18 generally includes regions of the outsole 16 corresponding with rear regions of a human foot including the calcaneus bone and of a size corresponding with the outsole 16 and article of footwear 10. The forefoot region 22 generally includes regions of the outsole 16 corresponding with the toes and the joints connecting the metatarsals with the phalanges of the human foot of the size corresponding with the outsole 16 and article of footwear 10. The midfoot region 20 generally includes regions of the outsole 16 corresponding with an arch area of the human foot of the size corresponding with the outsole 16 and article of footwear 10. Accordingly, the midfoot region 20 is also referred to as the outsole arch region.

As used herein, a lateral side of a component for the article of footwear 10, such as an lateral edge 24 of the outsole 16, is a side that corresponds with the side of the foot of the wearer of the article of footwear 10 that is generally further from the other foot of the wearer (i.e., the side closer to the fifth toe of the wearer). The fifth toe is commonly referred to as the little toe. A medial side of a component for the article of footwear 10, such as a medial edge 26 of the outsole 16, is the side that corresponds with an inside area of the foot of the wearer and is generally closer to the other foot of the wearer (i.e., the side closer to the hallux of the foot of the wearer). The hallux is commonly referred to as the big toe. The lateral edge 24 and the medial edge 26 both extend around the periphery of the outsole 16 from the foremost or forefoot edge 28 to the rearmost or heel edge 30 of the outsole 16. The outsole 16 can be a single-piece or unitary structure and can be manufactured using an insert molding process. The material for the outsole 16 may be selected to provide a desirable combination of durability and flexibility. For example, the outsole 16 may be wholly or partly made of a thermoplastic, such as a thermoplastic rubber, ethylene vinyl acetate (EVA) or other suitably durable material. As a non-limiting example, the outsole 16 is wholly or partly made of thermoplastic polyurethane (TPU).

Aside from the outsole 16, the sole structure 12 may include other sole structure bodies 15, such as a midsole 32. The midsole 32 overlays at least part of the outsole 16. Specifically, in the depicted embodiment, the midsole 32 is directly secured to the outsole 16 and extends over a majority or all the outsole 16. The midsole 32 defines an upper midsole surface 19 and a lower midsole surface 21 opposite to the upper midsole surface 19. The upper midsole surface 19 faces away from the outsole 16, and the lower midsole surface 21 faces toward the outsole 16. The midsole 32 is wholly or partly made of a material that combines a desired level of resiliency and support, such as an ethylene vinyl acetate (EVA) foam and polyurethane foam.

The sole structure 12 further includes an insole 34 that overlays the midsole 32. The insole 34 may be alternatively referred to as sock liner and is directly secured to the midsole 32 and extends over a majority of the upper midsole surface 19. The insole 34 may be made of a cushioning foam material, such as a lighter weight and less rigid foam than the midsole 32. For instance, the insole 34 may be formed of a deformable (for example, compressible) material, such as polyurethane foams, EVA foams, or other polymer foam materials. As a non-limiting example, the insole 34 may be wholly or partly made of a blend of the EVA and Nitrile rubber. Accordingly, the insole 34 may, by virtue of its compressibility, provide cushioning, and may also conform to the foot in order to provide comfort, support, and stability. The insole 34 has a foot-receiving surface 36 and a midsole-facing surface 38 opposite the foot-receiving surface 36.

The midsole 32 is at least partly disposed between the outsole 16 and the insole 34. The outsole 16 and the midsole 32 can be secured to one another by thermoforming during a molding process, by thermoplastic layers that melt to bond the components, by adhesives, or by any other suitable manner. The footwear upper 14 is secured in any suitable manner to the sole structure 12. More specifically, the footwear upper 14 is secured to an inner outsole peripheral surface 51 of the outsole 16, and to an inner midsole peripheral surface 52 of the midsole 32. The footwear upper 14 may include one or more materials (for example, textiles, foam, leather, and synthetic leather), which may be stitched, adhesively bonded, molded, or otherwise formed to define an interior void configured to receive a foot. The material for the upper 14 may be selected and arranged to selectively impart properties such as durability, air-permeability, wear-resistance, flexibility, and comfort.

Figure 3:
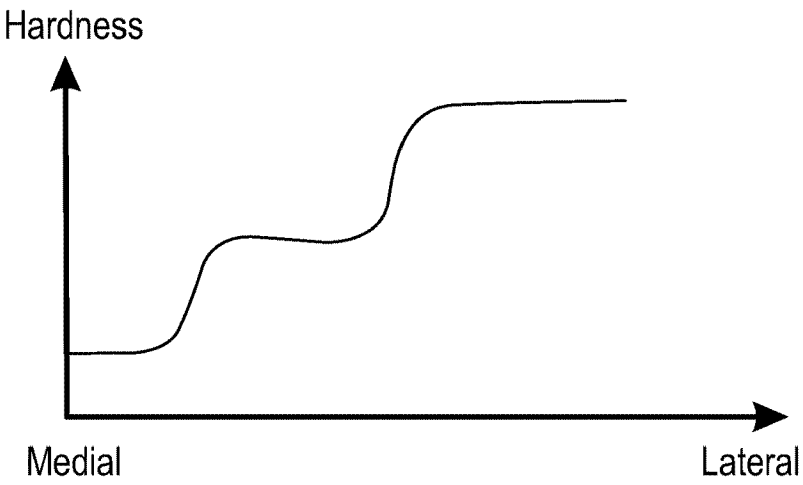
FIG. 3 is a plot of the hardness of the sole structure from the medial side to the lateral side.

In the depicted embodiment, the outsole 16 includes a plurality of body segments 42 having different hardnesses, causing the total hardness of the outsole 16 to vary (e.g., increase) from the medial edge 26 to the lateral edge 24. In the present disclosure, the term "hardness" means the resistance of a material to permanent deformation (e.g., permanent indentation). As a non-limiting example, the indentation hardness of the sole structure body 15 (e.g., the outsole 16) may increase from the medial edge 26 to the lateral edge 24 of the sole structure 12 in a stepped manner as shown in FIG. 3. As used herein, the term "indentation hardness" means the hardness of a material measured through a test in which the material is indentation until a permanent impression is formed. Indentation hardness tests include Vickers hardness test, Brinell hardness test, Knoop hardess test, Janka hardness test, Meyer hardness test, Rockwell hardness test, Shore hardness test, and Barcol hardness test. Although the drawings show the outsole 16 having the body segments, it is contemplated that any other sole structure body 15 may include the body segments 42 with different hardnesses. The different hardnesses of the body segments 42 serve as a training feedback tool for a golfer. In particular, because of the different hardness, the body segments 42 induce foot pronation during a golf swing. It is desirable to induce foot pronation during the follow through of a golf swing in order to maximize the distance and accuracy of a golf shot.

In the depicted embodiment, the sole structure body 15, such as the outsole 16, includes only three body segments 42, namely, a first body segment 42*a*, a second body segment 42*b*, and a third body segment 42*c*. It is contemplated, however, that the sole structure 15 may include more or fewer body segments 42. The first body segment 42*a* extends along the forefoot region 22, the midfoot region 20, and the heel region 18. The second body segment 42*b* extends along the forefoot region 22, the midfoot region 20, and the heel region 18. The third body segment 42*c* extends along the midfoot region 20 and the heel region 18. The third body segment 42*c* does not extend along the forefoot region 22. The location of the first body segment 42*a*, the second body segment 42*b*, and the third body segment 42*c* with respect to the forefoot region 22, the midfoot region 20, and the heel region 18 of the sole structure 12, as described above, aids in the inducement of proper foot pronation during a golf swing.

The first body segment 42*a*, the second body segment 42*b*, and the third body segment 42*c* are made of different materials each having a different hardness. For this reason, the sole structure 12 is referred to as a multi-durometer sole structure. In particular, the first body segment 42*a* is wholly or partly made of a first material having a first hardness, and the second body segment 42*b* is wholly or partly made of a second material having a second hardness. The hardness of the material forming the second body segment 42*b* (i.e. the second hardness) is greater than the hardness of the material forming the first body segment 42*a* (i.e., the first hardness). The third body segment 42*c* is wholly or partly made of a third material having a third hardness. The hardness of the material forming the third body segment 42*c* (i.e., the third hardness) is greater than the hardness of the materials forming the first body segment 42*a* (i.e., the first hardness) and the second body segment (i.e., the second hardness). The hardness of the materials, as described above, can help a golfer to maximize the energy transfer from the club to the ball during a golf swing by inducing proper foot pronation.

For example, the hardness of the material forming the first body segment 42*a* (i.e., the first hardness) may range between the twenty (20) Shore C and twenty-five (25) Shore C. The hardness of the material forming the second body segment 42*b* (i.e., the second hardness) may range between fifty (50) Shore C and fifty-five (55) Shore C. The hardness of the material forming the third body segment 42*c* may range between the eighty (80) Shore C and eight-five (85) Shore C. The hardness ranges, as described above, can help a golfer to maximize the energy transfer from the club to the ball during a golf swing by inducing proper foot pronation.

As a non-limiting example, the first body segment 42*a* may be wholly or partly made of an ethylene propylene diene monomer (M-class) (EDPM) rubber. The third body segment 42*c* may be wholly or partly made of nitrile butadiene rubber (NBR). The second body segment 42*b* may also be wholly or partly made of NBR with a lower acrylonitrile (ACN) content than the NBR forming the third body segment 42*c*. The ACN content in the NBR influences the hardness of the NBR. As the ACN increases, the hardness of the NBR increases. Accordingly, the first body segment 42*a*, the second body segment 42*b*, and the third body segment 42*c* may all be made of NBR but with different ACN content. Specifically, the ACN content of the NBR forming the first body segment 42*a* is less than the ACN content of the NBR forming the second body segment 42*b*, and the ACN content of the NBR forming the second body segment 42*b* is less than the ACN content of the NBR forming the third body segment 42*c*.

The majority of the third body segment 42*c* is closer to the lateral edge 24 than to the medial edge 26 of the sole structure 12. The majority of the first body segment 42*a* is closer to the medial edge 26 than to the lateral edge 24 of the sole structure 12. The second body segment 42*b* is partly disposed between the first body segment 42*a* and the third body segment 42*c*. The location of the first body segment 42*a*, the second body segment 42*b*, and the third body segment 42*c* with respect to the medial edge 26 and the lateral edge 24, as described above, aids in the inducement of proper foot pronation during a golf swing. The first body segment 42*a* forms a majority of the forefoot region 22, and the third body segment 42*c* forms a majority of the heel region 18 to induce pronation of the sole structure 12 toward the medial edge 26 during a golf swing.

The third body segment 42*c* defines a plurality of openings 44, such as slots. Each opening 44 extends through the entire thickness of the third body segment 42*c* and is configured, shaped, and sized to receive a protrusion 46 of the second body segment 42*b*. Accordingly, the second body segment 42*b* includes a plurality of protrusions 46 each extending through one of the openings 44 of the second body segment 42*b*. The protrusions 46 are parallel to each other in order to induce foot pronation uniformly across a wearer's foot. Further, the protrusions 46 are disposed along the lateral edge 24 of the sole structure body 15, and each protrusion 46 is obliquely angled relative to the central longitudinal axis X. Due to the orientation of the protrusions 46 relative to the central longitudinal axis X and the lateral edge 24, the sole structure body 15 can comfortably support the user's foot while inducing foot pronation during a golf swing.

The first body segment 42*a* has a peripheral edge (i.e., the first peripheral edge 48) and a transitional edge (i.e., the first transitional edge 50). The first peripheral edge 48 coincides with (i.e., occupies the same space as) a portion of the medial edge 26. The first transitional edge 50 includes a linear edge portion (i.e., the first linear edge portion 54) intersecting the forefoot edge 28 of the sole structure body 15. The first linear edge portion 54 of the first body segment 42*a* may be parallel to the central longitudinal axis X. The first transitional edge 50 further includes a convex edge portion (i.e., the convex edge portion 56) directly connected to the first linear edge portion 54. In addition, the first transitional edge 50 includes an angled edge portion (i.e. the first angled edge portion 58), which is obliquely angled relative to the central longitudinal axis X. The first angled edge portion 58 is directly connected to the convex edge portion 56. The convex edge portion 56 allows most of the ball of the wearer's foot to be positioned on the "soft" material (i.e., the material forming the first body segment 42*a*), whereas the wearer's heel is mostly split between the second and third materials (i.e., the material forming the second body segment 42*b* and the third body segment 42*c*). In addition, the convex edge portion 56 also provides the golfer with a sense of "digging in," thereby allowing the golfer to pre-load the front foot for an explosive downswing. Due to the convex edge portion 56 as well as the shape of the other transitional edges portions, the sole structure body 15 has a deformation gradient vector V, which is oriented toward the medial edge 26 and obliquely angled relative to the central longitudinal axis X when the sole structure 12 is loaded with a uniform pressure. Moreover, the first transitional edge 50 includes a curved edge portion (i.e., the first curved edge portion 60) directly connected to the first angled edge portion 58. The first curved edge portion 60 intersects the medial edge 26. Overall, the first transitional edge 50 abuts the second body segment 42*b*. The structure, configuration, parts, and orientation of the first transitional edge 50, as described above, can induce the user to properly pronate his foot during a golf swing.

The second body segment 42*b* includes a medial transitional edge (i.e., the second medial transitional edge 62), which has the same shape and configuration as the first transitional edge 50. As such, the second medial transitional edge 62 abuts the first transitional edge 50. In addition, the second body segment 42*b* has a lateral transitional edge (i.e., the second lateral transitional edge 64) abutting the third body segment 42*c*. The second lateral transitional edge 64 intersects the lateral edge 24 and the heel edge 30 of the sole structure body 15 and includes a linear edge portion (i.e., the second linear edge portion 66). The second linear edge portion 66 intersects the lateral edge 24 of the sole structure body 15 and is obliquely angled relative to the central longitudinal axis X. The second lateral transitional edge 64 further includes a concave edge portion (i.e., the concave edge portion 68) directly connected to the second linear edge portion 66. The concave edge portion 68 may have the same curvature as the convex edge portion 56. The second lateral transitional edge 64 also includes an angled edge portion (i.e., the second angled edge portion 70) directly connected to the concave edge portion 68. The second angled edge portion 70 is obliquely angled relative to the central longitudinal axis X. The second lateral transitional edge 64 also includes a curved edge portion (i.e. the second curved edge portion 72) connected to the second angled portion 70. The second curved edge portion 72 intersects the heel edge 30 and may have the same curvature as the first curve edge portion 60. The structure, configuration, parts, and orientation of the second lateral transitional edge 64, as described above, can induce the user to properly pronate his foot during a golf swing. The third body segment 42*c* has a medial transitional edge (i.e., the third medial transitional edge 74), which has the same shape and configuration as the second lateral transitional edge 64. In addition, the third body segment 42*c* has a peripheral edge (i.e., the third peripheral edge 76) that coincides with (i.e., occupies the same space as) at least a portion of the lateral edge 24 of the sole structure body 15. The structure, configuration, parts, and orientation of the third peripheral edge 76, as described above, can induce the user to properly pronate his foot during a golf swing. Each of the transitional edges (e.g., the first transitional edge 50 and the second lateral transitional edge 64) can at least partially overlap to provide a smoother hardness gradient. In particular, each of the transitional edges (e.g., the first transitional edge 50 and the second lateral transitional edge 64) is directly connected to a transitional surface 57 that is obliquely angled relative to the central longitudinal axis X. As a result, the body segments (i.e., the first body segment 42*a*, the second body segment 42*b*, and the third body segment 42*c*) at least partially overlap along the thickness of the sole structure body 15 in order to provide a smoother hardness gradient as shown in FIG. 3. On a backswing, the present sole design allows the front foot to pronate with a bias toward dropping the medial ball of the foot. This preloads the foot position to permit a powerful forward ankle roll/foot supination as weight is shifted forward. Conversely, the present sole design allows the back foot to collapse/pronate as weight is shifted toward the front foot. As a consequence, the sole structure 12 facilitates a more explosive weight transfer during the downswing While the best modes for carrying out the teachings have been described in detail, those familiar with the art to which this disclosure relates will recognize various alternative designs and embodiments for practicing the teachings within the scope of the appended claims.

What is claimed is:

1. A multi-durometer sole structure for a golf shoe to promote improved forward weight transfer, the sole structure comprising:

a sole structure body including a forefoot region, a heel region, and a midfoot region between the heel region and the forefoot region, a medial edge, a lateral edge opposite the medial edge, an upper surface, and a ground facing surface opposite the upper surface, wherein the sole structure body includes:

a first body segment extending along the forefoot region, the midfoot region, and the heel region;

a second body segment extending along the forefoot region, the midfoot region, and the heel region;

a third body segment extending along midfoot region and the heel region;

wherein the first, second, and third body segments are made of different materials having three different hardnesses, respectively, such that a total hardness of the sole structure body varies from the medial edge to the lateral edge;

wherein the first body segment defines a portion of the medial edge, the third body segment defines a portion of the lateral edge, and the second body segment is disposed between the first body segment and the third body segment; and wherein each of the first body segment, the second body segment, and the third body segment defines an inner body surface and an outer body surface opposite the inner body surface, and each inner body surface forms a portion of the upper surface of the sole structure body, and each outer body surface forms a portion of the ground facing surface of the sole structure body.

2. The sole structure of claim 1, wherein the first, second, and third body segments are made of different materials having three different hardnesses, respectively, such that a total hardness of the sole structure body increases from the medial edge to the lateral edge to induce a pronation of the sole structure when worn by a user.

3. The sole structure of claim 1, wherein the first body segment is made of a first material, the second body segment is made of a second material, the first material has a first hardness, the second material has a second hardness, and the second hardness is greater than the first hardness.

4. The sole structure of claim 3, wherein the third body segment is made of a third material, the third material has a third hardness, and the third hardness is greater than the second hardness.

5. The sole structure of claim 4, wherein the first body segment is wholly made of the first material, and the first hardness ranges between twenty Shore C and twenty-five Shore C.

6. The sole structure of claim 5, wherein the second body segment is wholly made of the second material, and the second hardness ranges between fifty Shore C and fifty-five Shore C.

7. The sole structure of claim 6, wherein the third body segment is wholly made of the third material, and the third hardness ranges between eighty Shore C and eighty-five Shore C.

8. The sole structure of claim 1, wherein a majority of the first body segment is closer to the medial edge than to the lateral edge.

9. The sole structure of claim 1, wherein a majority of the third body segment is closer to the lateral edge than to the medial edge.

10. The sole structure of claim 1, wherein the second body segment is partly disposed between the first body segment and the third body segment.

11. The sole structure of claim 1, wherein the third body segment does not extend along the forefoot region.

12. The sole structure of claim 1, wherein the third body segment defines a plurality of openings, and the second body segment includes a plurality of protrusions each through one of the openings.

13. The sole structure of claim 12, wherein the plurality of protrusions are parallel to one another.

14. The sole structure of claim 12, wherein the plurality of protrusions is disposed along the lateral edge of the sole structure body.

15. The sole structure of claim 12, wherein the sole structure body extends along a central longitudinal axis, and each of the protrusions is obliquely angled relative to the central longitudinal axis.

16. The sole structure of claim 1, wherein the sole structure body has a deformation gradient vector oriented toward the medial edge when the sole structure is loaded with uniform pressure.

17. A multi-durometer sole structure, comprising:

a sole structure body defines a medial edge and a lateral edge opposite the medial edge, wherein the sole structure body includes:

a forefoot region, a heel region, and a midfoot region between the heel region and the forefoot region;

an upper surface and a ground facing surface opposite the upper surface;

a plurality of body segments interconnected to one another; and wherein the body segments have different hardnesses such that a total hardness of the sole structure body varies from the medial edge to the lateral edge in a stepped manner;

wherein the plurality of body segments includes:

a first body segment extending along the forefoot region, the midfoot region, and the heel region;

a second body segment extending along the forefoot region, the midfoot region, and the heel region; and a third body segment extending along midfoot region and the heel region;

wherein the first body segment defines a portion of the medial edge, the third body segment defines a portion of the lateral edge, and the second body segment is disposed between the first body segment and the third body segment; and wherein each of the first body segment, the second body segment, and the third body segment defines an inner body surface and an outer body surface opposite the inner body surface, each inner body surface forms a portion of the upper surface of the sole structure body, and each outer body surface forms a portion of the ground facing surface of the sole structure body.

18. The sole structure of claim 17, wherein the first, second, and third body segments are made of different materials having three different hardnesses, respectively, such that a total hardness of the sole structure body increases from the medial edge to the lateral edge.

19. The sole structure of claim 17, wherein the first body segment is made of a first material, the second body segment is made of a second material, the first material has a first hardness, the second material has a second hardness, and the second hardness is greater than the first hardness.

20. The sole structure of claim 19, wherein the third body segment is made of a third material, the third material has a third hardness, and the third hardness is greater than the second hardness.

21. The sole structure of claim 20, wherein the first body segment is wholly made of the first material, and the first hardness ranges between twenty Shore C and twenty-five Shore C.

22. The sole structure of claim 21, wherein the second body segment is wholly made of the second material, and the second hardness ranges between fifty Shore C and fifty-five Shore C.

23. The sole structure of claim 22, wherein the third body segment is wholly made of the third material, and the third hardness ranges between eighty Shore C and eighty-five Shore C.

24. The sole structure of claim 17, wherein a majority of the first body segment is closer to the medial edge than to the lateral edge.

25. The sole structure of claim 17, wherein a majority of the third body segment is closer to the lateral edge than to the medial edge.

26. The sole structure of claim 17, wherein the second body segment is partly disposed between the first body segment and the third body segment.

27. The sole structure of claim 17, wherein the third body segment does not extend along the forefoot region.

28. The sole structure of claim 17, wherein the third body segment defines a plurality of openings, and the second body segment includes a plurality of protrusions each through one of the openings.

29. The sole structure of claim 28, wherein the plurality of protrusions are parallel to one another.

* * * * *